US007870633B2

(12) United States Patent
Thiebaut

(10) Patent No.: US 7,870,633 B2
(45) Date of Patent: Jan. 18, 2011

(54) APPLICATOR FOR MAKE-UP REMOVER

(75) Inventor: Laure Thiebaut, Clichy (FR)

(73) Assignee: L'oreal, Paris (FR)

( * ) Notice: Subject to any disclaimer, the term of this patent is extended or adjusted under 35 U.S.C. 154(b) by 1185 days.

(21) Appl. No.: 11/302,254

(22) Filed: Dec. 14, 2005

(65) Prior Publication Data

US 2006/0162735 A1 Jul. 27, 2006

Related U.S. Application Data

(60) Provisional application No. 60/639,858, filed on Dec. 29, 2004.

(30) Foreign Application Priority Data

Dec. 15, 2004 (FR) ..... 04 52997

(51) Int. Cl.
*A47L 13/16* (2006.01)

(52) U.S. Cl. ..... 15/209.1; 15/244.1; 15/244.4

(58) Field of Classification Search ..... 15/244.1, 15/244.3, 244.4, 209.1, 229.14
See application file for complete search history.

(56) References Cited

U.S. PATENT DOCUMENTS

| | | | | |
|---|---|---|---|---|
| 3,742,242 | A | 6/1973 | Morio et al. | |
| 4,140,409 | A * | 2/1979 | DeVries | 401/132 |
| 4,430,013 | A | 2/1984 | Kaufman | |
| 5,267,369 | A * | 12/1993 | O'Neil et al. | 15/210.1 |
| 5,900,068 | A * | 5/1999 | Thomas | 134/6 |
| 6,315,480 | B1 | 11/2001 | Martel et al. | |
| 2002/0026678 | A1 * | 3/2002 | Gustafsson et al. | 15/209.1 |

FOREIGN PATENT DOCUMENTS

WO 98/45127 10/1998

* cited by examiner

*Primary Examiner*—Shay L Karls
(74) *Attorney, Agent, or Firm*—Oblon, Spivak, McClelland, Maier & Neustadt, L.L.P.

(57) ABSTRACT

An applicator includes a support on one face of which is attached a resiliently deformable applicator element presenting an application surface opposite the support. The support has a preferential folding axis such that, in response to a folding force exerted on the support, the applicator element is deformed so as to modify the transverse curvature of the application surface observed transversely to the axis. The lengthwise curvature of the application surface observed axially along the axis is also modified.

41 Claims, 3 Drawing Sheets

Fig. 5
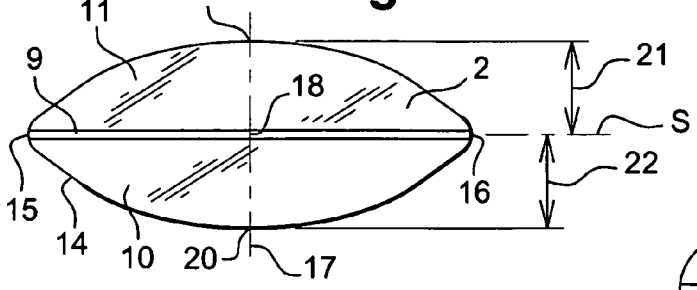
Fig. 6
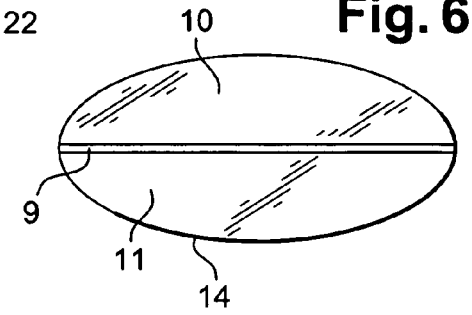
Fig. 7
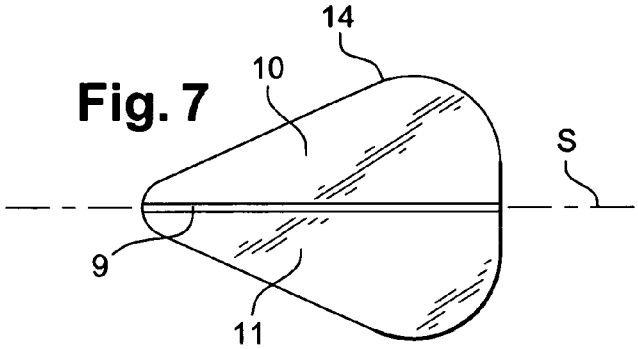
Fig. 8
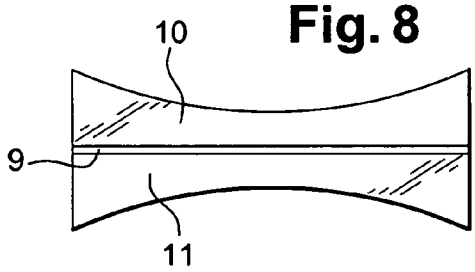
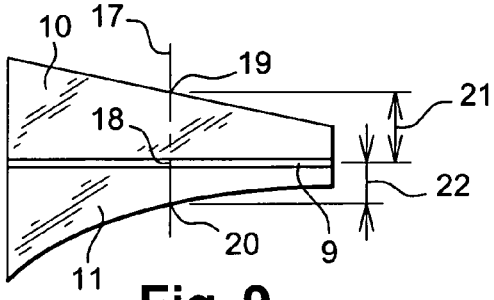
Fig. 9
Fig. 10
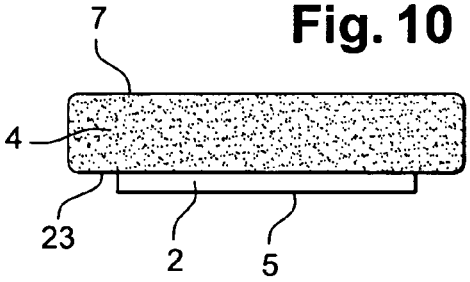
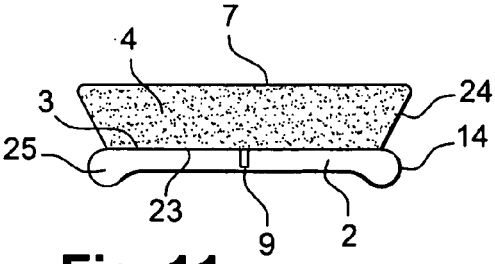
Fig. 11
Fig. 12
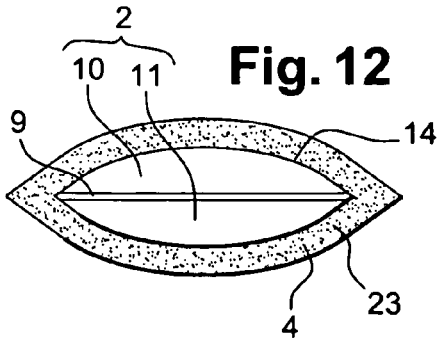

APPLICATOR FOR MAKE-UP REMOVER

CROSS-REFERENCE TO RELATED APPLICATIONS

This application claims priority to French Application No. 0452997, filed Dec. 15, 2004 and U.S. Provisional Application No. 60/639,858, filed Dec. 29, 2004, the entire contents of both of which are hereby incorporated by reference.

BACKGROUND OF THE INVENTION

1. Field of the Invention

The present invention relates to an applicator for the application of a cosmetic product. For example, the applicator can be impregnated with a make-up remover product to facilitate the removal of make-up, and in particular to remove make-up from the eyes, eyelashes, eyebrows and eyelids.

2. Discussion of the Background

The expression "cosmetic product" is understood to mean a product as defined in Council Directive 93/35/EEC dated 13th Jun. 1993.

It is known to use a make-up remover composition to remove make-up from the face. These compositions are either applied directly onto the face, in which case they are removed together with the make-up with cotton pads, or are deposited on a cotton pad or a non-woven wipe so as to apply the composition by lightly rubbing the skin, thereby completely removing the make-up from the face.

In these cases, the removal of make-up can be expensive as it requires the use of numerous cotton pads or wipes to properly remove the make-up, ensuring that all of the make-up and all of the make-up remover composition latterly applied is removed. Moreover, these cotton pads or wipes are typically not subsequently re-used. In fact, given that the make-up remover compositions and the removed make-up are generally liquid and viscous, they irreversibly degrade and soil the initial aerated structure of the cotton or wipe. Furthermore, as the cotton pads used with such compositions are formed from agglomerated fibres, they may not be easily washed. The same applies to non-woven wipes.

Furthermore, when a user wishes to remove make-up from her eyelashes when they are heavily coated with a layer of dry mascara, for example with a cotton pad impregnated with a make-up remover composition, a large proportion of the composition remains in the cotton pad without contributing to removal of the make-up. Also, any mascara that is partially dissolved by the composition released, for example under the effect of pressure applied to the cotton pad, can then be trapped in the mesh of the cotton fibres while at the same time remaining attached to the eyelashes. This may result in the eyelashes being pulled out when the user moves the cotton pad lightly along the row of eyelashes to be cleaned.

Document U.S. Pat. No. 3,742,242 describes a known make-up remover tip made of synthetic foam.

Document U.S. Pat. No. 4,140,409 describes a known packaging device for a liquid composition carried within a container including a pre-cut portion to which is attached an applicator element overlying the portion. The container and the applicator element are designed to cooperate so that the liquid is dispensed through the applicator element when the container is folded on itself so as to break the pre-cut portion, thus enabling the product to emerge from the container.

This applicator is not particularly ergonomic for the removal of make-up, as it does not render the application surface offered by the applicator element adaptable to the application of a product onto non-flat surfaces having both concavities and convexities in an environment of small dimensions. For instance, the application may need to be accomplished in a very precise manner so as to avoid bringing liquid into contact with the eyes. The outline of the eyes presents concavities and convexities due in particular to the proximity of the bridge of the nose, the curvature of the eyelids and the top and bottom rows of eyelashes which are neither the same length, nor similarly positioned, relative to the eye opening. Moreover, make-up remover compositions can cause eye irritation.

SUMMARY OF THE INVENTION

There is a need for a novel applicator facilitating the removal of make-up. Preferably, the applicator can be reusable and/or washable.

There is also a need, for some applications, for a novel applicator capable of releasing a high proportion of the liquid composition with which it is impregnated, so that the latter is used efficiently to obtain the desired make-up removal action. Preferably, the application surface is non-irritant and avoids the loss of eyelashes as the make-up is being removed. Considering that the loss of eyelashes is typically not desired by the user, due to the prolonged change in appearance resulting therefrom, there is a need in some applications for a novel applicator for make-up removal products that avoids or reduces such eyelash loss as the make-up is being removed. Preferably, the same hand gestures is retained to remove the make-up by lightly rubbing the rows of eyelashes with the applicator.

An object of an embodiment of the invention is to provide an applicator including a support on one face of which is attached a resiliently deformable applicator element presenting an application surface opposite the support. The support can have, in this embodiment, a preferential axis of folding such that, in response to a folding force exerted on the support, the applicator element can be deformed thereby modifying the transverse curvature of the application surface observed transversely to the axis. The applicator element can be configured so that, in response to the folding force exerted on the support, the lengthwise curvature of the application surface observed axially along the axis, is modified. In a particular embodiment, the distance, measured orthogonally to the folding axis, between an edge of the support and the folding axis varies along at least a portion of the folding axis.

Preferably, under the effect of resilient return forces generated by the applicator, and when the folding force is relaxed, the application surface reverts to its initial shape.

In a preferred embodiment, in its initial form, with no force exerted, the application surface can be flat, whereas under the effect of a first folding force, exerted on the support in a direction opposite the application surface, the application surface can include at least one convex transverse cross-section and at least one concave lengthwise cross-section.

Alternatively, in its initial form, with no force exerted the application surface can be flat, whereas under the effect of a second folding force, distinct from the first, the application surface includes at least one concave transverse cross-section and at least one convex lengthwise cross-section.

When the application surface presents a convex transverse cross-section, it facilitates the removal of make-up from the eyelids and/or lower eyelashes, whereas the formation of a concave transverse cross-section improves the removal of make-up from the upper eyelashes, as the latter can be inserted into the concavity thus formed. The upper and lower surfaces respectively of this row of eyelashes can be simultaneously placed in contact with the application surface when the latter is concave.

The distance measured orthogonally to the folding axis and determined between the edge of the support and the folding axis can vary along the axis non-monotonously along the folding axis.

For example, when it is subjected to a folding force, the applicator element is less compressed overall at a first transverse cross-section than at a second transverse cross-section of the applicator element. The distance between the folding axis and the intersection of the edge of the support with this first transverse cross-section is shorter than the distance between the folding axis and the intersection of the edge of the support with the second transverse cross-section.

In a particular embodiment, the at least one portion of the folding axis can account for at least 10% of the length of the folding axis.

The support can be divided into two portions by the fold line, and the effect of exerting a folding force is such that a first part of the support is caused to rotate about the folding axis, for example so as to perform a rotation of between 90° C. and 180° C. from the initial position in which the two portions extend in the same plane.

In a particular embodiment of the invention, the support can be made of a thermoplastic material, and preferably polyethylene. For example, the applicator element can be made at least partially of foam. In particular, the support can have a thickness between 0.3 and 2 mm, and the applicator element can have a thickness between 5 and 15 mm. The thickness of the applicator element can be chosen in relation to the largest dimension of the applicator element measured transversely to the folding axis.

In a particular embodiment, the applicator element can be attached to the support with an adhesive. As another possibility, the support can also be held mechanically in a seating formed in the applicator element. In this case, it can be held for example with a block disposed in the seating so as to press it against an inner perimeter delineating an access window to the seating.

The preferential folding axis can be obtained by pre-cutting the support so as to make a dotted line or by reducing the thickness of the support along the axis. In the latter case, the pre-cut can be made partially in the thickness of the support. However, as a variant, insofar as the support is integral with the applicator element, the folding axis can also correspond to a line of total separation between the two portions together forming the support. In this case, the reduced thickness of the support is zero along a line separating the two distinct portions. If appropriate, the reduced thickness portion of the support forming the folding axis can also be obtained during injection moulding of the support in a suitable mould with a film hinge for example.

The applicator element can present an axis of symmetry that is substantially superimposable on the folding axis.

In the case where the applicator has a lengthwise axis, the latter can be substantially superimposable on the folding axis.

Preferably, the application surface presents a surface area greater than or equal to that of the face of the support. Thus, irrespective of the manner in which the applicator is folded, the edges defining the outline of the applicator can project relative to the edges of the support.

Another embodiment of the invention relates to a method of manufacturing such an applicator, this method involving the following steps:

producing a wall designed to form the support, coating a face of this wall with an adhesive, applying a layer of a material designed to form the applicator element, and cutting the assembly formed by the wall attached to the layer so as to individualise the applicators, this cutting being concomitant with partial cutting of the wall so as to form a preferential folding axis on each applicator.

A final stripping step can be performed. This involves discarding the cut portions that do not form part of the applicators thus cut out.

The invention also relates to a method of applying a make-up remover composition and removing make-up from the face, such as from the eyes. In the method, a device such as the one described above, can be subjected to a first folding force so that a concavity of the application surface observed axially along a folding axis in this first position causes at least one first portion of the application surface to be less compressed than the other portions of the applicator element. Then, by exerting a second folding force in a direction opposite the first force, the concavity of the application surface observed axially causes a second portion distinct from the first portion to be less compressed than the other portions, including the first portion.

BRIEF DESCRIPTION OF THE DRAWINGS

The invention will be better understood by reading the following description and by reference to the accompanying figures. These are given for guidance only and are in no way limitative of the invention. The figures show:

FIG. 5: a bottom view of the applicator in FIG. 1;

FIGS. 6 to 9: bottom views of alternative embodiments of applicators according to the invention;

FIGS. 10 and 11: sectional views of alternative embodiments of applicators according to the invention;

FIG. 12 to 14: bottom views of alternative embodiments of applicators according to the invention;

DESCRIPTION OF THE PREFERRED EMBODIMENTS

Figure 1:
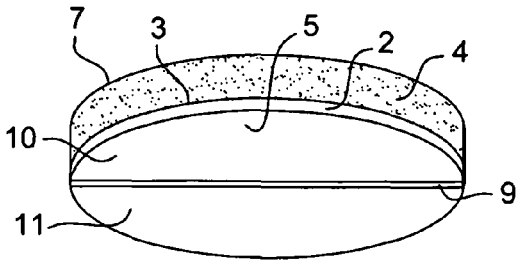
FIG. 1: a perspective view of an applicator according to an embodiment of the invention in an initial position with no force exerted.

FIG. 1 shows an applicator 1 including a support 2 on one face 3 of which is affixed an applicator element 4.

Figure 2:
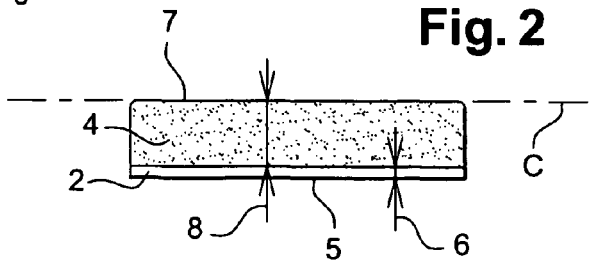
FIG. 2: a lengthwise sectional view of the applicator in FIG. 1.

The face 3 of the support 2 is substantially flat. Preferably, the support 2 is in the form of a plate then having a second face 5 opposite the face 3. In particular, the thickness 6, as depicted in FIG. 2, of this plate forming the support 2 can be between 0.3 mm and 2 mm, and preferably of the order of 0.5 mm.

The applicator element 4 presents an application surface 7, this surface 7 being substantially opposite the second face 5. In particular, in the embodiments shown, the application surface 7 is substantially flat when the device is not subjected to any force, and in particular any folding force. In a storage position, with no force exerted, the application surface 7 is parallel to the second face 5. In particular, the thickness 8, as depicted in FIG. 2, of the applicator element 4 can be between 5 mm and 15 mm, and preferably of the order of 12 mm.

The applicator element 4 is made of a resiliently deformable material, for example foam, in particular a foam of polyurethane, polyethylene, polyvinyl chloride, polyether, polyester, acrylonitrile butadiene rubber, styrene butadiene rubber, without this list being limitative. In particular, this foam is of the open or semi-open cell type so that it can be impregnated with product, in particular a cosmetic product, and so that it is able to absorb the make-up dissolved by the cosmetic product in order to remove it from the skin to which it has been previously applied.

Alternatively, the applicator element 4 can be of a material other than foam, for example felt, sponge or a plastic or mineral agglomerate. The applicator element 4 can have a monobloc or multi-layered structure, and can for example include a woven, non-woven or flock material at the surface. The application surface 7 may or may not include a flock covering. The applicator element 4 can contain a bactericidal or anti-fungal agent, as the case may be.

The support 2 is preferably made of a thermoplastic material such as for example a polyolefin material, such as polyethylene, polypropylene, or polyvinyl chloride. As a variant, it can also be made of card, and the latter can be plastic-coated or varnished.

The applicator element 4 is mounted on the face 3. For example, in FIGS. 1 to 9, the applicator 1 forms a cylinder of which the base is determined by the outer circumference of the support 2. In a particular embodiment, the application surface 7 can be of a size strictly identical to that of the face 3.

To facilitate deformation of the applicator 1, obtained manually, the support 2 has a preferential folding axis 9. This folding axis 9 in the support 2 can take the form, for example, of a continuous or discontinuous straight line of reduced thickness fashioned in the support 2. In particular, the reduction in thickness 6 can be partial or total. This line or folding axis 9 separates the support 2 into two portions respectively 10 and 11 on either side of this axis 9. In a position of rest, with no force exerted, the portions 10 and 11 are adjacent and extend in the same plane.

The applicator element 4 can be integral with the support 2, and in particular with the portions 10 and 11. It is for example attached by gluing with an adhesive applied in a thin layer on the face 3 of the support. In particular, this adhesive can be designed to set at room temperature, the adhesive bond being obtained after a given period of time, for example between several minutes and 24 hours. For example, a polyurethane-based adhesive is applied at the rate of 400 g/m2. The applicator element 4 and the support 2 can also be assembled by using a double-sided adhesive material, or by using a spray to apply a layer of adhesive of the neoprene type for example, or a roller to apply a layer of hot glue. To improve the bond provided by the adhesive, it may be advantageous or preferred to exert a force to press the applicator 4 onto the support 2 in order to increase the contact. As a variant, a mirror type weld can also be envisaged.

If a folding force is exerted so as to cause the portions 10 and 11 to move closer together by rotation about the folding axis 9, irrespective of the direction of rotation involved, the applicator element 4 will also be caused to move and compelled to fold.

Figure 3A:
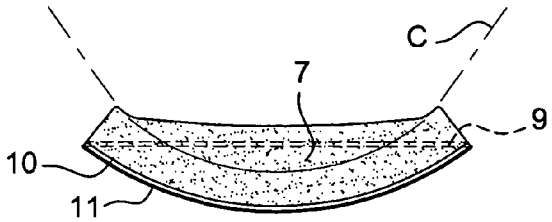
FIGS. 3*a* and 4*a*: perspective views of an applicator according to an embodiment of the invention subjected respectively to opposite folding forces.
Figure 3B:
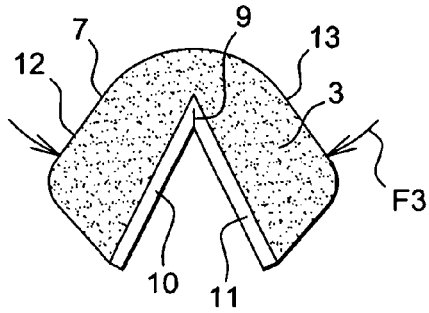
FIGS. 3*b* and 4*b*: transverse sectional views of an applicator according to FIGS. 3*a* and 4*a* respectively.

In FIGS. 3*a* and 3*b*, the first folding force F3 exerted on the applicator 1 tends to move the portions 10 and 11 directly together thereby causing the portions of the second face 5 respectively presented by these two portions to be positioned face-to-face. The force is exerted on the application surface 7. In fact, portion 10 is caused to rotate relative to portion 11 through at least 45°, preferably at least 90°, and preferably up to the limit of resilient deformation of the applicator 1, in particular through 180° of rotation, if permitted by the folding axis 9 and the applicator element 4.

When it is subjected to this first folding force F3, the application surface 7 presents a principally convex surface, the applicator element 4 being under tensile strain. This presentation of the application surface 7 is particularly suitable for application against an eyelid, and in particular in proximity to the roots of the lashes on this eyelid or the roots of the lashes on the lower outline of the eye.

Figure 4A:
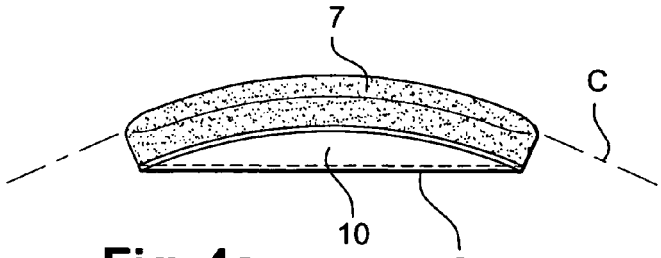
Figure 4B:
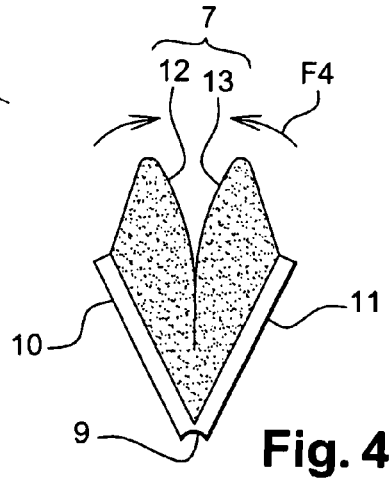

Conversely, as depicted in FIGS. 4*a* and 4*b*, the second folding force F4 exerted on the applicator 1 tends to move the portions 10 and 11 together so as to compress the applicator element between them, so that they present two portions 12 and 13 of the application surface 7 respectively facing each other, these portions being delineated on either side of a plane orthogonal to the application surface 7 and passing through the folding axis 9. In this case, portion 10 is caused to rotate relative to portion 11 through at least 45°, preferably through at least 90°, and preferably up to the compression limit of the applicator element 4. Being thus folded on itself, the application surface 7 presents a principally concave surface, the applicator element 4 being under compressive strain, the portions 12 and 13 are presented so as to create a pincer action suitable in particular for placement on either side of a row of eyelashes.

The deformation of the applicator element 4, when it is subjected to such folding forces, is not the same at every point, and its rate of deformation depends on the respective distances of the zone in question of the element 4 relative to the folding axis 9 and the peripheral edge 14 of the support 2.

Considering a line C formed by the intersection between the application surface 7 and a plane orthogonal to this application surface 7 in which the folding axis 9 extends, this line C is straight in the initial so-called "with no force exerted" position, insofar as the application surface 7 is substantially flat. In the embodiment illustrated in FIGS. 1 to 7, this line C is compelled to present at least one concavity when the applicator 1 is subjected to the first folding force F3, and at least one convexity when it is subjected to the second folding force F4.

In this embodiment, when the line C is concave, the application surface 7 is overall convex, whereas when the line C is convex, the application surface 7 is overall concave. Thus, for a given folding force, the applicator 1 can present a variation in the rate of deformation of the applicator element 4, in particular along the folding axis 9, where the variations are the most pronounced. The user can thus select the part of the applicator element 4 that is both the most comfortable and which permits precise application on the skin.

In FIG. 5, the peripheral perimeter 14 is substantially ovoid in shape and slightly tapering at two opposite axial ends of the support. In particular, as depicted in FIG. 5, the axial ends of the support correspond to the opposite axial ends 15 and 16 of the folding axis 9.

In particular, referring to all of the bottom views of the support such as 2, considering a straight line 17 normal to the folding axis 9, this line crosses the folding axis 9 at a first intersection point 18, and crosses the peripheral edge 14 respectively at a second and third intersection point respectively 19 and 20.

If this line 17 is displaced along the folding axis 9, over at least one portion of non-null length on this folding axis 9, it is seen that the distance 21 between the first intersection point 18 and the second intersection point 19 varies, and non-monotonously along the axis 9 in the embodiments depicted in FIGS. 5 to 8. This distance 21 varies along a portion of the folding axis 9 representing at least 10% of the length of this folding axis 9, and preferably at least 25%, and in particular 100%% of the length of the folding axis 9. The length of the folding axis 9 corresponds to the distance between the axial ends 15 and 16.

In particular, in the embodiments illustrated in FIGS. 5 to 8, the supports 2 have an axis of symmetry S substantially superimposable on the preferential folding axis 9.

However, the scope of the invention is not exceeded if, in displacing the normal line 17 along the folding axis 9, it is seen that the distance 21 varies along this axis 9 differently from the distance 22 between the first intersection point 18 and the third intersection point 20.

For the purposes of the invention, the expression "varying non-monotonously manner" is understood to mean that the respective distances 21 and 22 pass through at least one extreme position, for example a maximum. In particular, as depicted in FIG. 5, the normal line 17 shown passes through this maximum. Conversely, as depicted in FIG. 8, the respective distances 21 and 22 pass through a minimum. The distances 21 and 22 can also pass through two or more extreme positions.

In particular, according to the embodiments in FIGS. 5, 6 and 8, the single extreme position is reached in a central zone of the folding axis 9, whereas in the embodiment in FIG. 7, this extreme is reached away from this central zone, effectively imparting a pear shape to the peripheral perimeter 14.

This optimum can have a pointed shape, in particular triangular, or a rounded shape, in particular circular or ogival.

Furthermore, the scope of the invention is not exceeded when, in displacing the normal line 17 along the folding axis 9, as shown in FIG. 9, that the distance 21 varies monotonously, in particular linearly, along this axis 9, while the distance 22 can itself vary monotonously and in particular non-linearly, for example asymptotically, along this same axis 9.

In a variant not shown, the application surface 7 can be concave or convex in the initial "with no force exerted" position and can assume a flat application surface under the exertion of a folding force.

In another variant not shown, the applicator 1 can be covered on both its faces, respectively 3 and 5, by applicator elements such as 4, thereby doubling the application surfaces such as 7, of which the curvature, observed crosswise and lengthwise relative to the preferential folding axis 9, can be respectively modified in relation to folding forces exerted on the applicator 1. For example, the applicator 1 has a plane of symmetry in which for example the support 2 extends.

According to an alternative embodiment, in particular shown in FIGS. 10 and 12, the application surface 7 can be of a larger size than the faces 3 and respectively 5 of the support 2. In this particular embodiment, the applicator element 4 forms a cylindrical block, the surfaces 7 and 23 being identical. The support 2 is then fixed so as to be centered on the attachment surface 23, opposite the application surface 7 of the applicator element 4. Thus, no matter how the applicator 1 is manipulated, the support 2 presents no hard edges liable to be applied against the skin, the support being of limited thickness 6.

Conversely, in the embodiment depicted in FIG. 11, the attachment surface 23 is identical to that of the face 3 of the support 2, whereas the application surface 7 is larger, and the perimeter 24 of the applicator element 4 then presents inclined surfaces relative to the plane in which the application surface 7 extends. In addition, as a variant in the embodiment shown in FIG. 11, the thickness 6 of the support 2 is variable so as to form an annular bead 25 projecting beyond the second face 5 along the peripheral perimeter 14.

Figure 13:
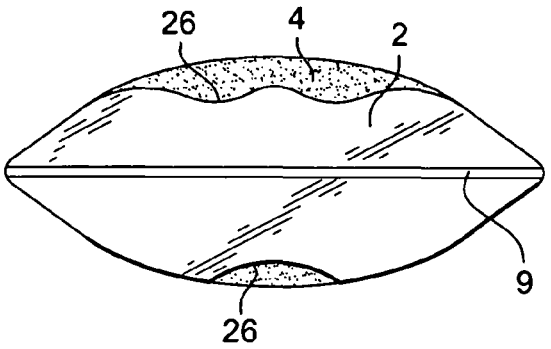
Figure 14:
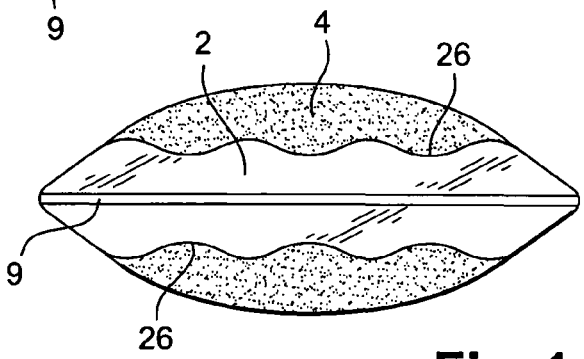

As a further variant, as depicted in FIGS. 13 and 14, the peripheral perimeter 14 of the support 2 can present inward indentations 26 thereby facilitating grasping of such an applicator 1 with the hand. Preferably, on either side of the fold line 9, it has at least one first indentation to accommodate the thumb and preferably at least two juxtaposed indentations placed opposite to accommodate the other fingers of the hand. This arrangement is particularly effective when the applicator 1 is held in one hand.

Figure 15:
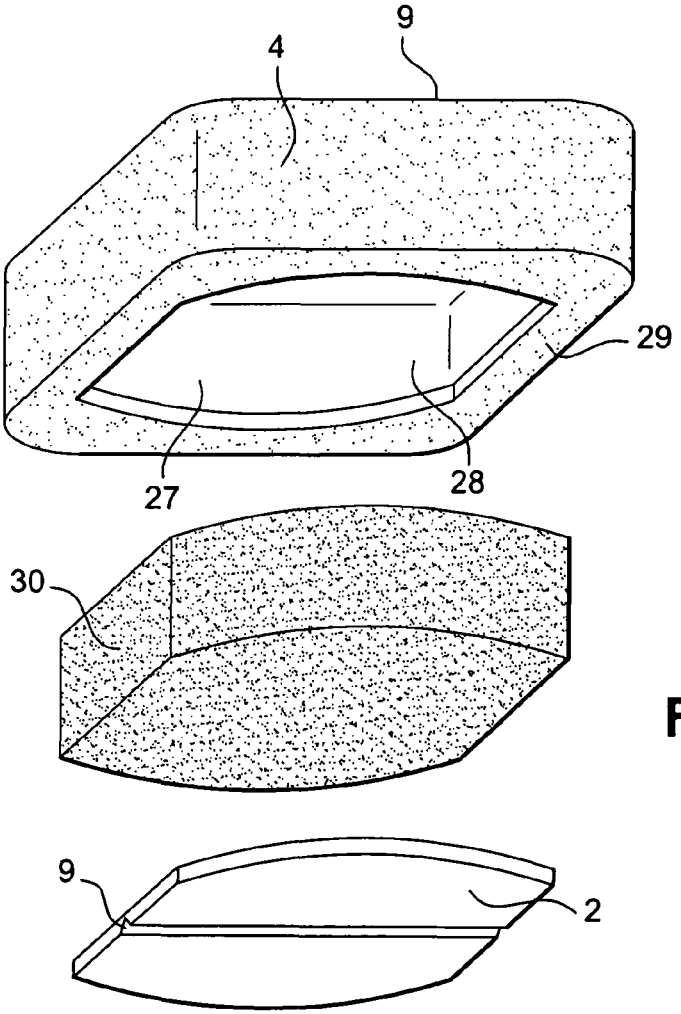
FIG. 15: an exploded perspective view of an applicator according to an embodiment of the invention.

As a variant, should it not be desirable to glue the support 2 to the applicator element 4, for example to avoid problems of solubilisation of the glue with the product to be impregnated therein, it is proposed in the embodiment depicted in FIG. 15 to make the applicator 4 so that it incorporates an inner seating 27, this seating emerging via an opening 28 at the attachment surface 23 opposite the application surface 7.

This seating 27 can be of a size adapted to enable the support 2 to be inserted by resilient deformation of the rim 29 of the opening 28. The support 2 is then held mechanically against the rim 29 and thereby retained within the seating 27 integral with the applicator element 4.

In this embodiment, it is preferable to make the applicator element 4 of a material that is pleasant to the touch, and to fill the seating 27, in this instance much larger, with a resiliently deformable block 30. This block 30 enables the support 2 to be pushed against the rim 29.

For example, and in this embodiment in particular, the support 2 can then be obtained by injection moulding, the fold line 9 corresponding to a film hinge formed in said support during the injection moulding process. In particular, the film hinge thus formed is designed to tolerate rotation through more than 340°, and preferably 360°, of the first portion 10 relative to the second portion 11.

Alternatively, and in particular for the manufacture of applicators such as those depicted in FIGS. 1 to 14, a layer of a material designed to form the applicator element 4 is glued to a layer of a material designed to form the support 2. Then, when this two-layer assembly has solidified, and in particular when the glue has set, as the case may be, the applicators can be cut to the desired pattern using a die-cutter. At this cutting stage, the fold line 9 is preferably made at the same time in each of the applicators such as 1.

The user equipped with an applicator 1 of this kind can impregnate it with a make-up remover composition. The support 2 being preferably impervious to the liquid product, the user's fingers are not made wet by this impregnating action. The user then manually exerts the second folding force on the applicator 1, for example in the direction of force F4, and places the upper row of mascara-coated lashes in the concavity thus presented by the application surface 7. She can thus thoroughly impregnate the mascara with make-up remover composition, thereby rapidly dissolving it, lightly rubbing the lashes to remove the mascara without exerting undue force on her lashes which is liable to cause them to fall out. When the make-up has thus been removed from the lashes, the peripheral perimeter 14 of the applicator element 4 is soiled by the mascara which was dissolved by the make-up remover composition.

Then, to remove make-up from the eyelid and the bottom row of lashes, still holding the applicator 1 in her hand, the user applies thereto the first folding force F3, thereby causing the application surface 7 to assume a convexity. Given that the applicator 1 is held at the peripheral perimeter, the soiled portion of the application surface 7 is remote from a central portion of the applicator element extending on the folding axis 9.

Given the convexity imparted to the application surface 7, the central portion can therefore be applied without applying the soiled portion against the eyelid. Furthermore, in this position the applicator element 4 is compressed in this central portion. The application surface 7 then offers less flexibility locally but greater precision of application of the composition, which in particular serves to remove the lift line on the eye contour.

In the case where the applicator element 4 is made of foam, after removing the make-up from one eye, the user can rinse the applicator in water so as to clear the application surface 7 of the make-up products removed from the first eye, and re-impregnate the applicator 1 to remove the make-up from the second eye. In the embodiment in which the applicator element 4 can be rinsed after this make-up removal operation, the same applicator can be re-used several times until it is spent.

In an alternative embodiment, the applicator element 4 can be pre-impregnated with a make-up remover composition, in dry or wet form. The applicator can be individually packaged for protection against external contamination. In the case where the impregnated make-up remover composition is in dry form, the user can moisten the applicator element before application.

Throughout the description, the expression "including one" should be regarded as synonymous with "including at least one," unless otherwise specified.

What is claimed as new and desired to be secured by Letters Patent of the United States is:

1. An applicator, comprising:

a support including two rigid halves disposed in a single plane and connected by a preferential folding axis, at least one of the rigid halves including a rounded edge portion such that a distance between an edge of the support and the folding axis varies along said folding axis non-monotonously; and a resiliently deformable applicator element on one face of said support, said applicator element being a foam pad including an application surface on a face of the applicator element opposite a face contacting the support, wherein the folding axis is coplanar with the support such that, in response to a folding force exerted on said support, the applicator element is deformed so as to modify a transverse curvature of the application surface observed transversely to said folding axis, wherein the application surface of the foam pad is an outermost face of the applicator, and wherein, in response to the folding force exerted on said support, a lengthwise curvature of the application surface observed axially, along said folding axis, is modified.

2. The applicator according to claim 1, wherein under an effect of resilient return forces generated by the applicator element when the folding pressure is relaxed, the application surface reverts to an initial shape.

3. The applicator according to claim 1, wherein the application surface is flat in an initial form, whereas under an effect of said folding force exerted on said support in a direction opposite the application surface, the application surface includes at least one convex transverse cross-section and at least one concave lengthwise cross-section.

4. The applicator according to claim 3, wherein the application surface is flat in an initial form, whereas under an effect of a second folding force on said support, the application surface includes at least one concave transverse cross-section and at least one convex lengthwise cross-section.

5. The applicator according to claim 1, wherein the application surface is flat in an initial form, whereas under an effect of said folding force, the application surface includes at least one concave transverse cross-section and at least one convex lengthwise cross-section.

6. The applicator according to claim 1, wherein, in response to said folding force, the applicator element is less compressed overall at a first transverse cross-section than at a second transverse cross-section of the applicator element, a distance between the folding axis and an intersection of the edge of the support with the first cross-section being shorter than a distance between the folding axis and an intersection of the edge of the support with the second cross-section.

7. The applicator according to claim 1, wherein the distance between the edge of the support and said folding axis varies along at least 10% of the length of the folding axis.

8. The applicator according to claim 1, wherein, when the folding force is exerted, the two halves of the support located on opposite sides of the folding axis are caused to rotate relative to each other about the folding axis, and complete a rotation of between 90° and 130° from an initial position in which the two halves extend in a same plane.

9. The applicator according to claim 1, wherein the support is made of a thermoplastic material.

10. The applicator according to claim 1, wherein the support has a thickness of between 0.3 and 2 mm, and the applicator element has a thickness of between 5 and 15 mm.

11. The applicator according to claim 1, wherein the applicator element is attached to the support with an adhesive.

12. The applicator according to claim 1, wherein the support is held mechanically in a seating formed in the applicator element.

13. The applicator according to claim 12, wherein said support is held with a block arranged in the seating, said block being configured to hold the support against an inner rim delineated by an access window to the seating.

14. The applicator according to claim 1, wherein the support is pre-cut so as to form the folding axis in this pre-cut zone.

15. The applicator according to claim 14, wherein the pre-cut zone is dotted.

16. The applicator according to claim 1, wherein the folding axis corresponds to a zone of reduced thickness of the support.

17. The applicator according to claim 16, wherein said zone of reduced thickness is obtained from a partial cutting through a thickness of the support.

18. The applicator according to claim 16, wherein said zone of reduced thickness is obtained from injection moulding of said support in a mould.

19. The applicator according to claim 1, further comprising an axis of symmetry substantially superimposable on the folding axis.

20. The applicator according to claim 1, further comprising a lengthwise axis substantially superimposable on the folding axis.

21. The applicator according to claim 1, wherein the application surface includes a surface area greater than or equal to that of the face of the support.

22. The applicator of claim 1, wherein the rounded edge portion is concave.

23. The applicator of claim 22, wherein both halves include a concave rounded edge portion along an entire length of the folding axis.

24. The applicator of claim 1, wherein at least one of the halves includes one portion where the distance between the edge of the support and the folding axis varies along said folding axis monotonously and another portion where the distance varies along said folding axis non-monotonously.

25. The applicator of claim 1, wherein along one of the halves the distance between the edge of the support and the folding axis varies monotonously and the other half the distance between the edge of the support and the folding axis varies non-monotonously.

26. The applicator of claim 1, wherein along one of the halves the distance between the edge of the support and the folding axis varies monotonously along an entire length of the axis and the other half the distance between the edge of the support and the folding axis varies non-monotonously along an entire length of the axis.

27. An applicator, comprising:

a support including an upper face and a lower face and having a reduced thickness along a line defining a preferential folding axis of said support, the axis being coplanar with the support, the support including a rounded edge portion such that a distance between an edge of the support and the folding axis varies along said folding axis non-monotonously; and an applicator element being a foam pad coupled to said support and having an application surface on one of the upper face or lower face of the applicator element opposite a face contacting the support, wherein the application surface of the foam pad is an outermost face of the applicator, wherein, in an initial form when no force is applied to the support, the upper face is parallel to the lower face, wherein, when said support is folded along said preferential folding axis in a first configuration, said applicator element is under tensile strain and said application surface forms a convex surface, and when said support is folded along said preferential folding axis in a second configuration, said applicator element is under compressive strain and the application surface forms a concave surface.

28. The applicator of claim 27, wherein, in said second configuration, said application surface forms two portions facing each other and forming a concavity at a central portion of said applicator element, said central portion being between said two portions.

29. The application of claim 28, wherein, in said first configuration, said application surface forms a convexity at said central portion of said applicator element.

30. The applicator of claim 27, wherein the applicator element is water rinsable.

31. The applicator of claim 27, wherein the applicator element is pre-impregnated with a make-up remover composition.

32. The applicator of claim 27, wherein said support is impervious to a liquid product.

33. The applicator of claim 27, wherein said support is flat when said support is not folded.

34. The applicator of claim 33, wherein said application surface is parallel to said support when said support is not folded.

35. The applicator of claim 27, wherein said support is V-shaped in said first and second configurations as viewed along said preferential folding axis.

36. The applicator of claim 27, wherein said support is symmetric with respect to said preferential folding axis.

37. The applicator of claim 27, wherein said support is not symmetric with respect to said preferential folding axis.

38. The applicator of claim 27, wherein said support is symmetric along a line normal to said line of reduced thickness and passing through a midpoint of said line of reduced thickness.

39. The applicator of claim 27, wherein said support is not symmetric along a line normal to said line of reduced thickness and passing through a midpoint of said line of reduced thickness.

40. The applicator of claim 27, wherein said reduced thickness is zero so that said support is divided into two distinct portions separated by said line.

41. The applicator of claim 27, wherein said applicator element is made of resiliently deformable material.

* * * * *